US005284302A

United States Patent [19]

Kato et al.

[11] Patent Number: 5,284,302

[45] Date of Patent: Feb. 8, 1994

[54] FUEL INJECTION VALVE

[75] Inventors: Masaaki Kato, Kariya; Yukio Sakamoto, Obu, both of Japan

[73] Assignee: Nippondenso Co., Ltd., Kariya, Japan

[21] Appl. No.: 16,220

[22] Filed: Feb. 11, 1993

[30] Foreign Application Priority Data

Feb. 12, 1992 [JP] Japan ..... 4-025082

[51] Int. Cl.[5] ..... F02H 51/06

[52] U.S. Cl. ..... 239/585.1; 251/129.15

[58] Field of Search ..... 239/585.1-585.5; 251/129.15, 129.51

[56] References Cited

U.S. PATENT DOCUMENTS

| | | | |
|---|---|---|---|
| 4,417,693 | 11/1983 | Fussner et al. . | |
| 4,705,219 | 11/1987 | Pagdin | 239/585.1 X |
| 4,766,405 | 8/1988 | Daly et al. . | |
| 5,033,716 | 7/1991 | Mesowick | 251/129.21 |
| 5,139,224 | 8/1992 | Bright | 251/129.15 X |
| 5,161,778 | 11/1992 | Motykiewicz | 251/129.15 |
| 5,203,538 | 4/1993 | Matsunaga et al. | 239/585.1 X |
| 5,219,122 | 6/1993 | Iwawaga | 239/585.1 X |

FOREIGN PATENT DOCUMENTS

| | | |
|---|---|---|
| 53-59131 | 5/1978 | Japan . |
| 57-195861 | 12/1982 | Japan . |
| 58-54266 | 12/1983 | Japan . |
| 1-224451 | 9/1989 | Japan . |
| 1-224452 | 9/1989 | Japan . |

*Primary Examiner*—Andres Kashnikow
*Assistant Examiner*—Kevin P. Weldon
*Attorney, Agent, or Firm*—Cushman, Darby & Cushman

[57] ABSTRACT

An electromagnetic fuel injection valve includes a needle valve having a sealed bore of a specified length formed therein a guide hole within which the needle valve is movable. A stopper plate and a valve seat portion ar provided for defining opened and closed positions of the needle valve. Further, a magnetic powder of a specified mass is movably received in the bore. When the needle valve collides with the stopper plate or the valve seat portion, the magnetic powder is moved by an inertia force acting. Due to collision of the magnetic powder with an end of the bore with a specified time lag, a bouncing force resulting from the collision of the needle valve can be canceled. Accordingly, a bounce of the needle valve can be restrained. further, since the inertia force acting on the magnetic powder is utilized, the durability can be improved as compared with the prior art.

9 Claims, 4 Drawing Sheets

FUEL INJECTION VALVE

BACKGROUND OF THE INVENTION

1. Field of the Invention

The present invention relates to a fuel injection valve of an internal combustion engine.

2. Description of the Related Art

In a fuel injection valve used conventionally, a needle valve is attracted by an electromagnetic force generated by a solenoid to open the valve and is urged by a spring to close the valve. When the valve is opened or closed, the needle valve collides with a member for cooperating to define an opened or closed position thereof and then may bounce. As the needle valve bounces at its opened or closed position, a secondary injection takes place to thereby deteriorate the linearity of the fuel measuring.

To solve this problem, Japanese Patent Examined Publication No. 58-54266 has proposed a counter technique. In this technique, a bounce in the valve opening is controlled by adding a pressure higher than fuel pressure to the back of a needle valve. On the other hand, in Japanese Patent Unexamined Publication No. 53-59131, a weight is provided in an upper portion of a needle valve so as to reduce the valve opening speed, thereby restraining a bounce in the valve opening.

In a fuel injection valve disclosed in Japanese Patent Examined Publication No. 58-54266, since a control portion for back pressure becomes large-scale and complicated, the apparatus itself is enlarged. Further, since a back pressure is applied to the needle valve, an excessive impact force is applied to a seat portion of the valve, resulting in a possibility that the durability of the seat portion is deteriorated. On the other hand, in a fuel injection valve disclosed in Japanese Patent Unexamined Publication No. 53-59131 as well, provision of a weight member brings about enlargement of the apparatus. Further, when the needle valve is seated, an additional impact force corresponding to the weight member is applied simultaneously, and therefore, there is caused a possibility that the strength and hence the durability of the seat portion is also deteriorated.

SUMMARY OF THE INVENTION

In view of the above-described problems, an object of the present invention is to provide a fuel injection valve having an improved durability and capable of restraining a bounce of a needle valve in at least one of the valve opening and the valve closing.

To this end, there is provided according to the present invention a fuel injection valve which comprises a needle valve axially movable to close or open a fuel passage, a definition member to which the needle valve is abutted for defining an amount of axial movement of the needle valve, and an inertial collision element axially movable by a specified distance with respect to the needle valve and capable of colliding against the needle valve to apply an inertia force thereto with a specified time lag after the needle valve collides with the definition member.

The needle valve tends to bounce due to a bounce force produced when the needle valve collides with the definition member. On the other hand, the inertial collision element is moved by a specified distance separately from the needle valve and it collides against the needle valve with a specified time lag after the collision of the needle valve with the definition member. Therefore, the inertia force of the inertial collision element is applied to the needle valve. This force resulting from by collision of the inertial collision element acts in a direction opposite to the direction of the bounce force produced between the needle valve and the definition member. As a result, the needle valve can be prevented from repelling the definition member so that the bounce of the needle valve can be controlled.

BRIEF DESCRIPTION OF THE DRAWINGS

FIG. 5 is a characteristic view showing the needle lift and the like.

DESCRIPTION OF THE PREFERRED EMBODIMENTS

Figure 1:
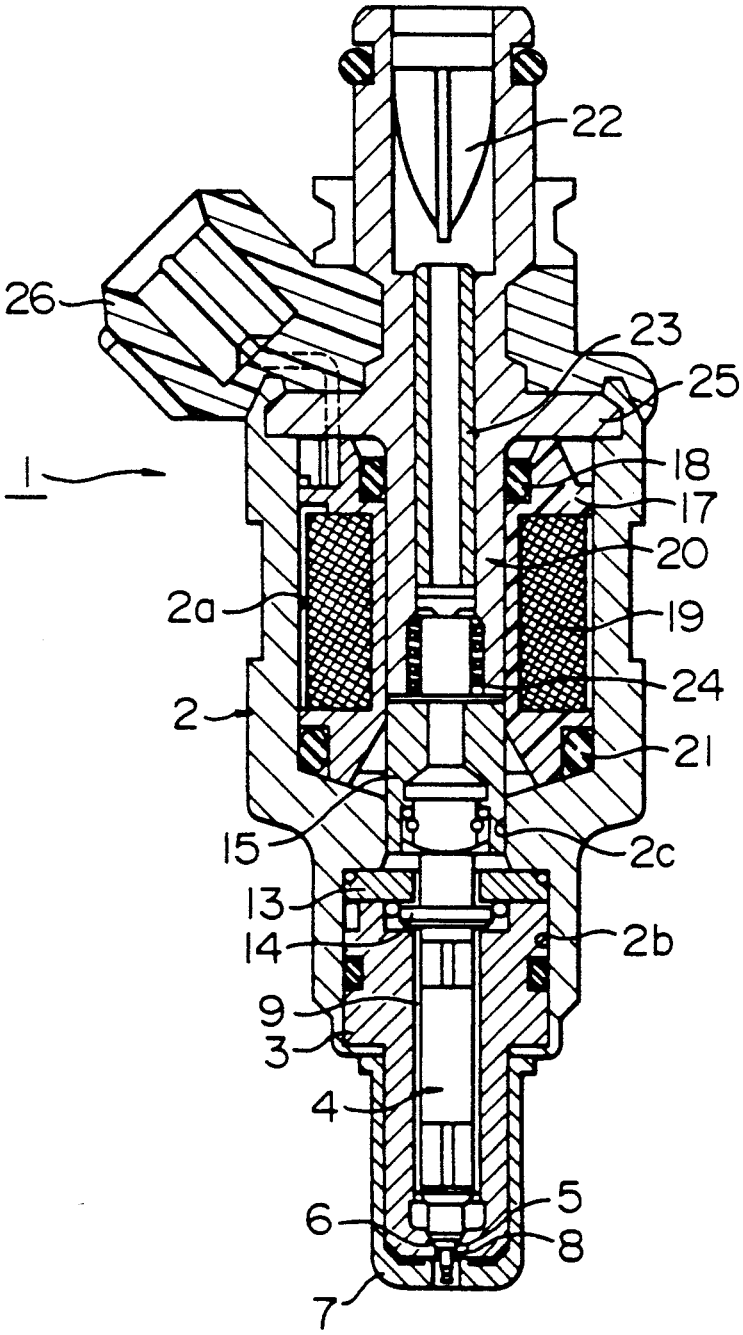
FIG. 1 is a vertical sectional view of an electromagnetic fuel injection valve according to a first embodiment of the present invention.

An electromagnetic fuel injection valve 1 shown in FIG. 1 is disposed in an intake pipe of a spark ignition type internal combustion engine which is to be mounted on a vehicle and serves to supply fuel to the intake pipe. A housing 2 which forms a main shell of the fuel injection valve 1 is formed substantially in a cylindrical shape. The inner periphery of the housing 2 comprises a large diameter portion 2*a*, a small diameter portion 2*c* and a medium diameter portion 2*b*.

Within the medium diameter portion 2*b* of the housing 2, a stopper plate 13 is disposed and, further, a valve body 3 is partially fitted. And, an opening end of the housing 2 is caulked on the outer periphery of the valve body 3 so that the housing 2 and the valve body 3 are connected integrally with each other.

Figure 2:
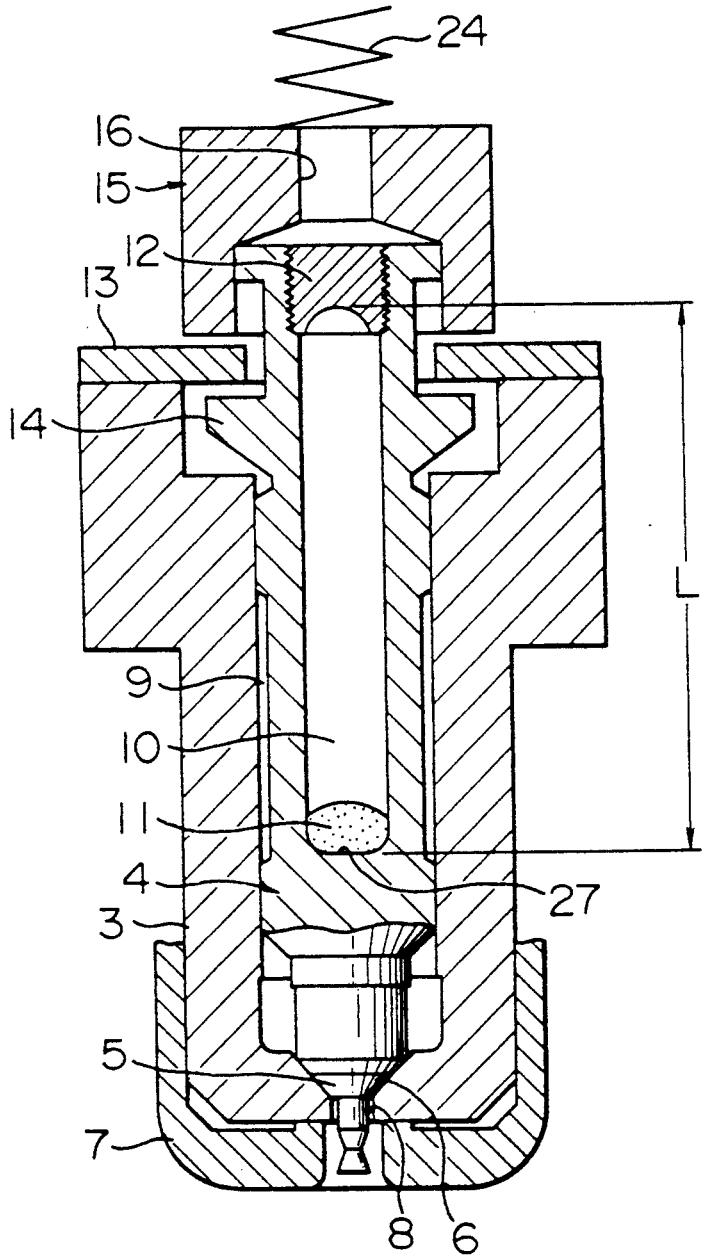
FIG. 2 is an enlarged fragmentary sectional view of a forward end portion of the fuel injection valve shown in FIG. 1.

Referring to FIG. 2, a guide hole 9 is formed within the valve body 3. At the bottom of the guide hole 9 is formed a substantially conical-shaped valve seat portion 6, and an injection hole 8 is formed in a center of the valve seat portion 6. Further, a bottomed cylindrical cap 7 is press-fitted on the outer periphery of the forward end portion of the valve body 3. In the center of the bottomed portion of the cap 7 is formed an aperture through which the fuel injected from the injection hole 8 passes.

A needle valve 4 is received in the guide hole 9 so as to be slidable in the vertical direction in the drawings. A tip end portion 5 of the needle valve 4 is formed in a substantially conical shape so as to be able to come in contact with the valve seat portion 6. By so doing, the valve seat portion 6 can serve to define a full-closed position of the valve 1 as well as to cut off the fuel when the tip end portion 5 of the needle valve 4 comes in contact therewith. Further, the needle valve 4 is formed therein with an axial bore 10. The bore 10 shown in FIG. 2 is so drawn as to have a specified length L which occupies most of a needle valve 4 for easy understanding of the construction of the present invention, and however, the length L is actually very short so that the bore 10 is very small as compared with the needle valve 4. Magnetic powder 11 is movably received in the bore 10. The magnetic powder 11 is made of a magnetic material which has a specified mass such as iron or cobalt. After the magnetic powder 11 is received in the bore 10, the bore 10 is sealed by means of a bolt 12. At this time, a length of the bore 10 from a bottom 27 thereof to the bolt 12 is set to be the specified length L.

In addition, the needle valve 4 is formed in an upper portion thereof with a flange 14. The flange 14 is brought into contact with the stopper plate 13 when the needle valve 4 is moved upward. By so doing, the stopper plate 13 can serve to define a full-opened position of the valve 1.

Moreover, an upper end of the needle valve 4 is extended through the stopper plate 13 so as to be press-fitted in a stepped hole 16 of an armature 15. The armature 15 which is a cylindrical member made of a magnetic material, is movably fitted in the small--diameter portion 2c of the housing 2 so as to be moved with the needle valve 4.

As shown in FIG. 1, a cylindrical stationary core 20 is disposed above the armature 15. The core 20 is formed with a flange 25 projecting from the cylindrical wall thereof and secured at the flange 25 thereof to the housing 2 by caulking an opening end of the large-diameter portion 2a of the housing 2. Further, an adjusting pipe 23 serving as a part of a fuel passage is secured in the core 20. And, a spring 24 is disposed between the adjusting pipe 23 and the armature 15. The biasing force of the spring 24 is adjusted depending on the position at which the adjusting pipe 23 is secured, and the spring 24 serves to bias the armature 15 in a direction toward the injection hole 8. Namely, the valve opening pressure is adjusted in accordance with the position where the adjusting pipe 23 is secured. Moreover, an upper end portion of the core 20 is communicated to a fuel pipe which is not shown. In this communication portion disposed is a filter 22.

A doughnut-like bobbin 17 is disposed between the large-diameter portion 2a of the housing 2 and the core 20. The bobbin 17 is made of a synthetic resin and an electromagnetic coil 19 is wound on the outer periphery thereof. Further, at the top and the bottom of the bobbin 17, O-rings 18 and 21 are disposed between the core 20 and the bobbin 17 and between the bobbin 17 and the housing 2, respectively. These O-rings 18 and 21 serve to prevent the fuel from leaking to the electro-magnetic coil 19.

Further, a feeder connector 26 made of a resin material is formed integrally with an upper surface of the flange 25. A terminal of the connector 26 is connected to the electromagnetic coil 19.

Next, operation of the first embodiment will be described.

In the construction described above, fuel is introduced from the upper end portion of the core 20. Fuel flows through the filter 22, the adjusting pipe 23 and the armature 15 into the outer periphery of the needle valve 4. An electric current is supplied to the electromagnetic coil 19 through the connector 26 in response to a control signal transmitted from an engine control unit in accordance with the rotational frequency and load of the engine. As the electric current is supplied, an electromagnetic force is generated so that the armature 15 is attracted to the core 20 against the biasing force of the spring 24. When the armature 15 is attracted to the core 20, the needle valve 4 is also moved upward simultaneously. And, as the flange 14 abuts against the stopper plate 13 which defines the full-opened position of the valve 1, the upward movement of the needle valve 4 is stopped, that is, the needle valve 4 reaches the full-opened position thereof.

At this time, fuel is injected from a gap formed between the tip end portion 5 of the needle valve 4 and the valve seat portion 6 into the intake pipe passing through the injection hole 8 and the aperture formed in the cap 7.

When the supply of electric current to the electromagnetic coil 19 is terrupted, the armature 15 separates from the core 20 due to the biasing force of the spring 24 so that the needle valve 4 is moved downward. When the tip end portion 5 of the needle valve 4 abuts against the valve seat portion 6 which defines the full-closed position of the valve 1, the needle valve 4 closes the valve to finish the fuel injection.

Figure 5B:
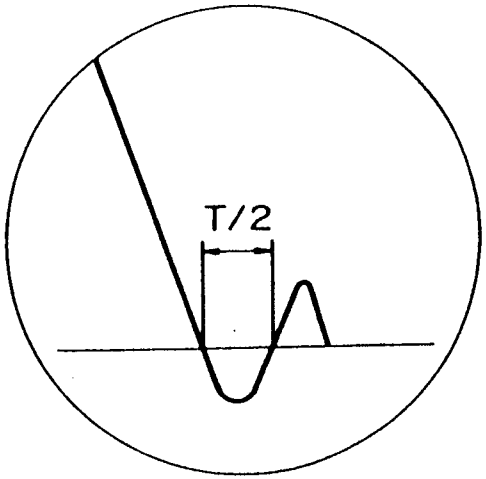
Figure 5A:
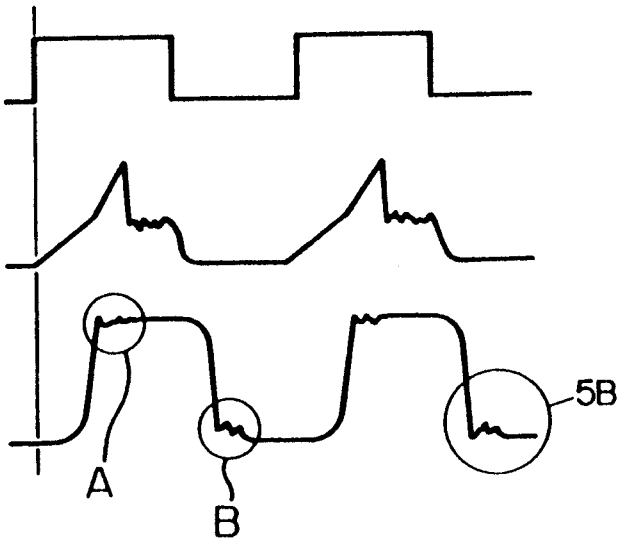

It is noted that when the needle valve 4 is moved up by attraction to cause the flange 14 to come in contact with the stopper plate 13, the kinetic energy of the needle valve 4 is absorbed by the needle valve 4 and the stopper plate 13 as elastic energy. However, the elastic energy absorbed by the needle valve 4 is released again to allow the needle valve 4 to bounce. If the bounce force at this time is lager than the attractive force generated by the electromagnetic coil 19, the needle valve 4 tends to bounce as shown in a section a of FIG. 5. FIG. 5 is a view showing a driving pulse for driving a needle valve, a waveform of an electric current applied to the electromagnetic coil in accordance with the driving pulse, and a needle lift of the needle valve caused by an electromagnetic force of the electromagnetic coil energized by this electric current.

The moment the needle valve 4 comes in contact with the stopper plate 13, the magnetic powder 11 is caused to move upward within the bore 10 separately from the needle valve 4, and it collides against the bolt 12 with a specified time delay after the collision of the needle valve 4 with the stopper plate 13. As a result, the inertia force of the magnetic powder material 11 is applied to the needle valve 4. The magnetic powder 11 is attracted by the magnetic force generated by the electro-magnetic coil 19 and rested on the bolt 12. The force resulting from the collision of the magnetic powder 11 acts in the opposite direction to the bounce force produced between the needle valve 4 and the stopper plate 13. For this reason, the needle valve 4 can be prevented from bouncing from the stopper plate 13 so that it is possible to restrain the bounce in the valve opening.

On the other hand, when the supply of electric current to the electromagnetic coil 19 is interrupted, the tip end portion 5 of the needle valve 4 is pushed back downward by the spring 24 and it collides with the valve seat portion 6. In this case, the kinetic energy of the needle valve 4 is absorbed by the needle valve 4 and the valve seat portion 6 as elastic energy similarly to the case of opening the valve. However, the elastic energy absorbed by the needle valve 4 is released again to allow the needle valve 4 to try to bounce from the valve seat portion 6. If the bounce force at this time is lager than the biasing force of the spring 24, the needle valve 4 tends to bounce in the valve closing as shown in a section B of FIG. 5.

The moment the tip end portion 5 of the needle valve 4 is seated in the valve seat portion 6, the magnetic powder material 11 is caused to move downward within the bore 10 separately from the needle valve 4 and it collides against the bottom 27 with a specified time lag after the collision of the needle valve 4 with the valve seat portion 6. As a result, the inertia force of the magnetic powder 11 is applied to the needle valve 4. The force resulting from the collision of the magnetic powder 11 acts in the opposite direction to the bounce force produced between the needle valve 4 and the valve seat portion 6. For this reason, the needle valve 4 can be prevented from bouncing from the valve seat portion 6 so that it is possible to restrain the bounce in the valve closing.

In order to effectively cancel the above-described bouncing force of the needle valve 4, a specified mass m of the magnetic powder 11 and a specified length L of the bore 10 which are shown in FIG. 2 are set as follows.

Assuming that a mass of the needle valve 4 is represented by M, a collision velocity of the needle valve 4 in the valve opening is represented by $v_1$, a resultant elastic modules of the needle valve 4 and the stopper plate 13 in the valve opening is represented by $k_1$, a collision velocity of the needle valve 4 in closing the valve is represented by $v_2$, a resultant elastic modules of the needle valve 4 and the valve seat portion 6 in the valve closing is represented by $k_2$, and the collision is a perfectly elastic collision, expressions of energy conservation in the valve opening and the valve closing are shown by the following equations, respectively.

$$\frac{1}{2} MV_1^2 = \frac{1}{2} k_1 X_1^2 \quad (1)$$

$$\frac{1}{2} MV_2^2 = \frac{1}{2} k_2 X_2^2 \quad (2)$$

where, $x_1$ is a sum of a shrinkage amount of the needle valve 4 and a deflection amount of the stopper plate 13 attributable to the collision of the needle valve 4 with the stopper plate 13 in the valve opening, and x2 is a sum of a shrinkage amount of the needle valve 4 and an extension amount of the valve body 3 attributable to the collision of the needle valve 4 with the valve seat portion 6 in the valve closing. And, conditions for making the bounce in the valve opening and the valve closing are shown by the following, respectively.

$$k_1 x_1 < F_{mag} - F_{a1} \quad (3)$$

$$k_2 x_2 < F_{s2} \quad (4)$$

where, $F_{Mag}$ is an attractive force of the electromagnetic coil 19, $F_{a1}$ is a set load of the spring 24 when the valve is opened, and $F_{s2}$ is a set load of the spring 24 when the valve is closed. Incidentally, pressure, viscosity and sliding resistance of the fuel oil are neglected.

Further, since the valve closing speed $v_2$ is higher than the valve opening speed $v_1$ in general, the bouncing force resulting from the kinetic energy of the needle valve 4 in the valve closing becomes greater than that in the valve opening. For this reason, the bounce in the valve closing can be restrained the bounce in the valve opening can be also restrained. Accordingly, description will be given of the method for restraining the bounce in the valve closing.

It is considered that the bounce in the valve closing can be restrained provided that a sum of a kinetic energy of the magnetic powder 11 and an elastic energy of the spring 24 in the valve closing exceeds a bouncing energy of the needle valve 4 required for the bounce in the valve closing. Accordingly, the following equation is obtained.

$$\frac{1}{2} k_2 x_2^2 \left( = \frac{1}{2} M v_2^2 \right) = \frac{1}{2} K X_2^2 + \frac{1}{2} m v_2^2 \quad (5)$$

where, K is a spring constant of the spring 24, and $X_2$ is a deflection amount of the spring 24 from the neutral length thereof resulting when the valve is closed.

According to the equation (5), it is possible to obtain the mass m of the magnetic powder 11.

Next, an oscillation frequency f of the needle valve 4 and the valve seat portion 6 is shown by the following.

$$f = 2\pi \sqrt{(k_2/M)} \quad (6)$$

It takes a half of one periodic time as shown in FIG. 5 that, after being seated, the needle valve 4 is rebounded by a displacement $x_2$ and is returned again to the zero displacement, and therefore, that time t is shown by the following equation.

$$t = \frac{T}{2} = \frac{1}{2} \cdot \frac{1}{f} = \frac{1}{4} \frac{1}{\pi \sqrt{(k_2/M)}} \quad (7)$$

where, T is a periodic time of oscillation. The specified length L of the bore 10 is obtained by the following equations.

$$t = L/v_2 \quad (8)$$

$$\therefore L = v_2 t \quad (9)$$

According to the equations (5) and (9), it is possible to set the specified mass m of the magnetic powder material 11 and the specified length L of the bore 10. Assuming that the mass of the needle valve 4 is 3 grams (M=3 g), the valve closing speed $v_2$ is 1 m/s, the spring constant K of the spring 24 is equal to 200 gf/mm and the set force is equal to 700 gf, for example, the specified mass m of the magnetic powder 11 becomes approx. 0.5 g. Further, assuming that the periodic time T of oscillation of the needle valve 4 is set as 1 ms, the specified length L of the bore 10 may be about 0.5 mm including a length occupied by the magnetic powder 11. Incidentally, the length L of the bore 10 is so drawn as to occupy most of the needle valve 4 in FIG. 2, and however, it is a very small space actually, as described above.

Using the magnetic powder 11 having the specified mass m set as described above and the bore 10 formed in the needle valve 4 and having the specified length L, the magnetic powder 11 is made to collide with the bolt 12 or the bottom 27 synchronously with the timing at which the needle valve 4. In this way, it is possible to effectively restrain the bounce of the needle valve 4 in the valve opening and the valve closing.

Accordingly, the linearity of the fuel injection rate control characteristic can be prevented from being deteriorated by the secondary injection or the like and a desired fuel injection rate can be achieved with high accuracy, and therefore, the emission of hydrocarbon or the like contained in the exhaust gas can be reduced. And, sine the bounce can be restrained by making use of the inertia force acting on the magnetic powder 11, the aforementioned conventional construction in which the seating portion is affected with an excessive impact may not be adopted. In consequence, the excessive impact to be applied to the seating portion of the needle valve can be lightened, thereby improving the durability of the seating portion and the needle valve.

Further, the needle valve 4 of the aforementioned first embodiment can be reduced in weight, and therefore, it is possible to reduce the impact force itself of the needle valve 4 as well as to improve the responsibility thereof.

Moreover, the inertial collision element, the magnetic powder 11 in the first embodiment may be an annular member formed by a magnetic material. The annular member is fitted on the outer peripheral surface of the needle valve 4 or the armature 15 so as to be axially movable within a specified distance. With such construction, after the needle valve 4 collides with the valve seat portion 6 or the stopper plate 13, the annular member is moved by the inertia force caused by the movement of the needle valve 4. Then, the annular member collides against the bottom 27 or the bolt 12 with a specified time lag, and therefore, a bouncing force resulting from the collision of the needle valve 4 can be canceled. In consequence, the annular member can achieve the same function as that of the magnetic powder material 11.

Figure 3:
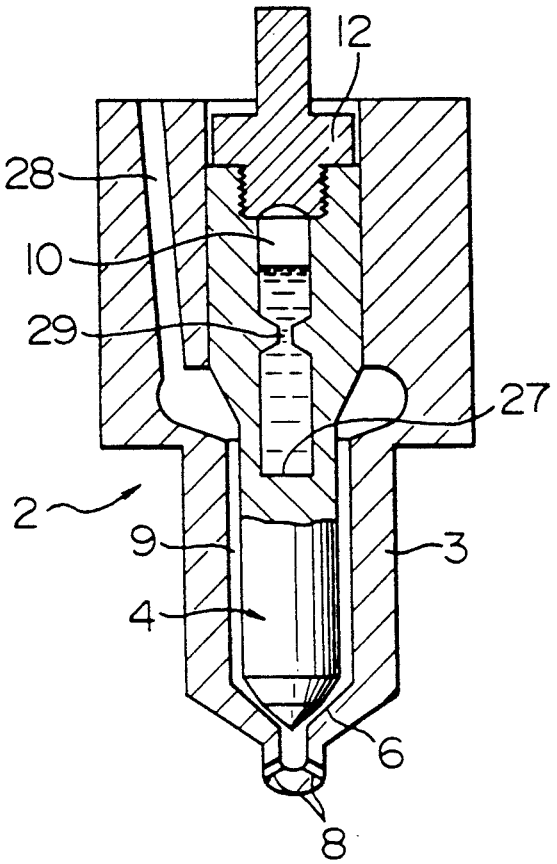
FIG. 3 is an enlarged fragmentary sectional view of a forward end portion of a fuel injection valve according to a second embodiment of the present invention.

Next, a fuel injection valve for Diesel engine according to a second embodiment of the present invention will be described with referring to FIG. 3.

In this fuel injection valve, a fuel passage 28 through which fuel is supplied is formed in the valve body 3 unlike the aforementioned first embodiment. Fluid is sealed in the bore 10 of the needle valve 4. This fluid contains for example a solvent which absorbs air. This enables the fluid to move within the bore 10. Alternatively, fluid may be sealed in a vacuum space in the bore 10. Further, the bore 10 is provided with a throttle 29 at an intermediate portion thereof.

With such construction, high-pressure fuel supplied from a fuel injection pump which is not shown flows through the fuel passage 28 to a guide hole 9. Due to the pressure of the fuel itself, the needle valve 4 is moved upward to collide with a stopper plate which is not shown. The upward movement of the needle valve 4 causes the fuel to be injected through injection holes 8. After the fuel is injected, the pressure of the fuel supplied from the fuel injection pump is reduced so that the needle valve 4 is pushed down by a spring which is not shown and comes in contact with the valve seat portion 6, thereby completing the fuel injection.

When the needle valve 4 is moved upward due to increase of the fuel pressure, fluid existing above and below the throttle 29 is moved upward with the needle valve 4. When the needle valve 4 collides against the stopper plate, fluid existing above the throttle 29 separates from the upper portion of the throttle 29 and moves upward within the bore 10 and it collides against the bolt 12 with a specified time lag after the collision of the needle valve 4 with the stopper plate. As a result, the inertia force of the fluid acts on the needle valve 4.

When the needle valve 4 collides with the stopper plate, the needle valve 4 tends to bounce due to the impact force resulting from the collision of the needle valve 4 with the stopper plate. However, the inertia force produced when the fluid existing above the throttle 29 collides with the bolt 12 acts in a direction opposite to the direction of the bounce in the valve opening, thereby restraining the bounce in the valve opening.

On the other hand, when the needle valve 4 is moved upward, fluid existing below the throttle 29 is moved upward with the needle valve 4 as well. As the needle valve 4 collides with the stopper plate, a part of the fluid moves upward due to its own inertia force and passes through the throttle 29, and therefore, a space equivalent in volume to the fluid thus passing through the throttle 29 is formed between the fluid remaining below the throttle 29 and the bottom 27. The fluid passing through the throttle 29 collides with the bolt 12 later than the fluid existing above the throttle 29. As a result, it is possible to restrain the bounce even if the needle valve 4 tends to bounce again.

In this way, the needle valve 4 is moved up and fuel is injected. After a specified injection time elapses, as the pressure of the fuel supplied from the fuel injection pump is reduced, the needle valve 4 is moved downward. At this time, since the injection time is short, the fluid in the bore 10 continues to move toward the upper part of the bore 10 due to the inertia force generated in the valve opening. Therefore, a part of the fluid is kept in contact with the bolt 12 while the remaining part of the fluid is kept in contact with the lower surface of the throttle 29.

In this state, as the needle valve 4 moves downward to collide with the valve seat portion 6, the needle valve 4 tends to bounce owing to the impact force.

On the other hand, the fluid in the bore 10 moves downward within the bore 10 separately from the needle valve 4 when the needle valve 4 collides with the valve seat portion 6. The fluid existing above and below the throttle 29 collides with the upper surface of the throttle 29 and the bottom 27, respectively, with a specified time lag after the collision of the needle valve 4 against the valve seat portion 6. As a result, the inertia force of the fluid acts on the needle valve 4. Since this inertia force acts in a direction opposite to the direction of the bounce in the valve closing, the bounce in the valve closing can be retained. Further, a part of the fluid existing above the throttle 29 passes through the throttle 29 and collides against the bottom 27 later than the fluid existing below the throttle 29. In consequence, it is possible to restrain the bounce even if the needle valve 4 tends to bounce again.

While the needle valve 4 is kept in contact with the valve seat portion 6, the fluid returns again to the illustrated state and waits for the next upward movement of the needle valve 4.

In this way, the bounce of the needle valve 4 in the valve opening and the valve closing can be restrained effectively.

Incidentally, a non-magnetic fluid is used in the second embodiment, however, the construction of the second embodiment may be adopted to the electromagnetic fuel injection valve of the first embodiment by using a magnetic fluid. For example, by using a magnetic fluid containing a magnetic powder, water and a surface active agent which helps them to mix with each other, the fluid serving as the inertial collision element can be moved also by the magnetic force of the electromagnetic coil like the aforementioned first embodiment, and therefore, it is possible to obtain the same function and effect as those of the first embodiment.

Figure 4:
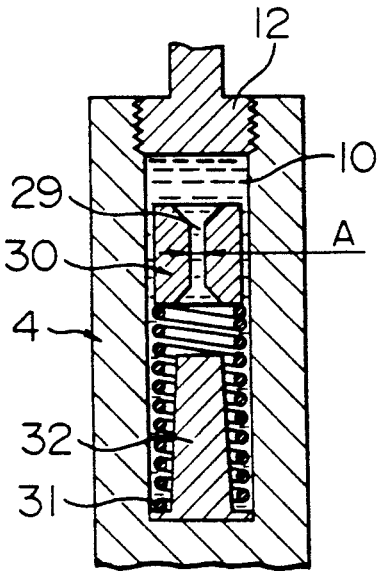
FIG. 4 is a vertical sectional view of a needle valve in a fuel injection valve according to a third embodiment of the present invention.

Moreover, a third embodiment of the present invention will be described with referring to FIG. 4. In the third embodiment, a piston 30 having the throttle 29 is used as the inertial collision element. The piston 30 is inserted in the bore 10 filled with a viscous fluid and is biased upwardly by a spring 31. Further, a collision rod 32 is provided at the lower end of the bore 10. The collision rod 32 serves to define the stroke of the movement of the piston 30.

A moving speed of the piston 30 can be adjusted and set freely by changing the opening area A of the throttle 29 and the viscosity $\eta$ of the viscous fluid, while the stroke of the movement of the piston 30 can be adjusted and set freely by changing the length of the collision rod 32. This makes it possible to make the needle valve fit for the characteristic of the individual injection valve. Further, by making the spring 31 project beyond the collision rod 32 by a specified amount, a distance from the piston 30 to the bolt 12 can be adjusted so that an impact force with which the piston 30 collides with the bolt 12 can be controlled. Moreover, when the piston 30 collides with the collision rod 32, an impact force applied to the collision rod 32 can be controlled owing to an elastic force of the spring 31. As a result, it becomes possible to obtain impact forces suitable for the bounces in the valve opening and the valve closing, respectively.

The needle valve of the third embodiment can be applied to the fuel injection valves for gasoline and Diesel engines. Further, in case of using in the electromagnetic fuel injection valve, the piston 30 may be made of a magnetic material.

Moreover, the collision rod 32 and the spring 31 may be provided above the piston 30 under certain circumstances. Further, in order to place the piston 30 more precisely, springs may be disposed not only between the piston 30 and the collision rod 32, but also between the piston 30 and the bolt 12.

As described above, the first, the second and the third embodiments of the present invention can be put into practice without changing the external form of the conventional fuel injection valve, and therefore, they can be actualized at low cost without enlarging the apparatus itself.

Incidentally, the embodiments have been described as being capable of controlling the bounce in both valve opening and closing, however, it doesn't matter if the bounce can be controlled in either one of the valve opening and closing under certain circumstances.

As has been described above, according to the fuel injection valve of the present invention, the needle valve is provided with the inertial collision element so as to apply the inertia force acting on the inertial collision element to the needle valve synchronously with the time at which the needle valve bounces. In consequence, it is possible to restrain the impact applied to the needle valve and the definition member, resulting in that the bounce of the needle valve can be restrained without deteriorating the durability of the fuel injection valve.

What is claimed is:

1. A fuel injection valve comprising:

a fuel passage;

a needle valve axially movable to open and close said fuel passage;

a definition member to which said needle valve is abutted, said member defining an amount of axial of said needle valve; and an inertial collision element axially movable by a specified distance with respect to said needle valve, for colliding against said needle valve with a specified time lag after said needle valve moves in a specified direction and collides with said definition member, thereby applying an inertia force to said needle valve in said specified direction.

2. A fuel injection valve according to claim 1, wherein said injection valve further comprises means for adjusting said specified time lag.

3. A fuel injection valve according to claim 2, wherein said adjusting means comprises means for setting a moving distance and a moving speed of said inertial collision element relative to said needle valve in such a manner that said inertial collision element collides with said needle valve when said needle valve bounces in a direction opposite to said specified direction after the collision with said definition member.

4. A fuel injection valve according to claim 3, wherein said needle valve is formed therein with a space extending in an axial direction, said inertial collision element includes a fluid received in said space, and said control means has a throttle for restricting flow of said fluid within said space.

5. A fuel injection valve according to claim 1, wherein said needle valve is formed in a cylindrical shape and provided therein with a space in which said inertial collision element is received.

6. A fuel injection valve according to claim 1, wherein said injection valve further comprises electromagnetic driving means disposed adjacent to one end of said needle valve and exerting a magnetic force to said needle valve to make it move, and wherein said definition member is located adjacent to the other end of said needle valve, and wherein said inertial collision element includes a magnetic member which is moved toward said one end of said needle valve by a magnetic force of said electromagnetic driving means and is moved, upon extinction of the magnetic force of said electromagnetic driving means, toward said other end.

7. A fuel injection valve according to claim 6, wherein said needle valve is disposed with one end thereof turned upside so that said inertial collision element is moved toward the other end of said needle valve by gravity.

8. A fuel injection valve according to claim 7, wherein said inertial collision element is a magnetic fluid received in a space being formed in said needle valve and extending in an axial direction.

9. A fuel injection valve according to claim 1, wherein said needle valve includes a space formed therein and extending in an axial direction and a fluid received in said space, and wherein said inertial collision element includes a piston member which is received in said space and is moved within said fluid, said piston member being formed with a throttle which controls flow of said fluid resulting from the movement of said piston member.

* * * * *